United States Patent [19]

Nowak

[11] Patent Number: 4,768,836

[45] Date of Patent: Sep. 6, 1988

[54] COAL SHAVER

[75] Inventor: Dieter Nowak, Herne, Fed. Rep. of Germany

[73] Assignee: Klöckner-Becorit GmbH, Castrop-Rauxel, Fed. Rep. of Germany

[21] Appl. No.: 163,213

[22] Filed: Feb. 23, 1988

Related U.S. Application Data

[63] Continuation of Ser. No. 861,297, May 9, 1986, abandoned.

[30] Foreign Application Priority Data

May 11, 1985 [DE] Fed. Rep. of Germany ..... 3517063

[51] Int. Cl.[4] ..... E21C 27/35; E21C 27/42

[52] U.S. Cl. ..... 299/34; 299/85

[58] Field of Search ..... 299/32, 34, 36, 85

[56] References Cited

U.S. PATENT DOCUMENTS

| | | | |
|---|---|---|---|
| 3,118,657 | 1/1964 | Lobbe | 299/34 |
| 3,445,138 | 5/1969 | Lobbe et al. | 299/34 |
| 3,804,465 | 4/1974 | Ostrop et al. | 299/34 |
| 4,025,117 | 5/1977 | Bahre et al. | 299/34 |
| 4,159,850 | 7/1979 | Lobbe et al. | 299/34 |

FOREIGN PATENT DOCUMENTS

| | | | |
|---|---|---|---|
| 2709392 | 9/1978 | Fed. Rep. of Germany . | |
| 2137962 | 8/1979 | Fed. Rep. of Germany . | |
| 2140609 | 12/1979 | Fed. Rep. of Germany . | |
| 2118713 | 4/1980 | Fed. Rep. of Germany . | |
| 3517063 | 9/1986 | Fed. Rep. of Germany . | |
| 6600653 | 7/1966 | Netherlands | 299/34 |

OTHER PUBLICATIONS

Operating Instructions for Coal Planar Devices Made by Gewerkschaft Eisenhütte Westfalia of Lünen, Federal Republic of Germany, p. 13, (1981).

Lürig et al., "Entwicklungsstand der Schälenden Gewinnung", in *Gluckauf,* 117, (1981), No. 11, pp. 625–631.

*Primary Examiner*—Stephen J. Novosad
*Assistant Examiner*—Bruce M. Kisliuk
*Attorney, Agent, or Firm*—Watson, Cole, Grindle & Watson

[57] ABSTRACT

A coal shaver includes an elongated carriage body that can be pulled by a link chain back and forth in parallel with the side wall of a coal deposit and two shaver devices respectively mounted on the elongated carriage body near its opposite ends. Each shaver device includes a first cutter member which includes a first elongated cutter strip of vertically spaced apart shearing blades that extend inwardly of the coal shaver, i.e., toward the first elongated cutter strip of the other shaver device, and towards the side wall of the coal deposit, and a second cutter member which is pivotally connected to the first cutter member so as to pivot about a horizontal axis, the second cutter member including a second elongated cutter strip which faces outwardly of the coal shaver and towards the side wall of the coal deposit.

9 Claims, 8 Drawing Sheets

Fig. 5
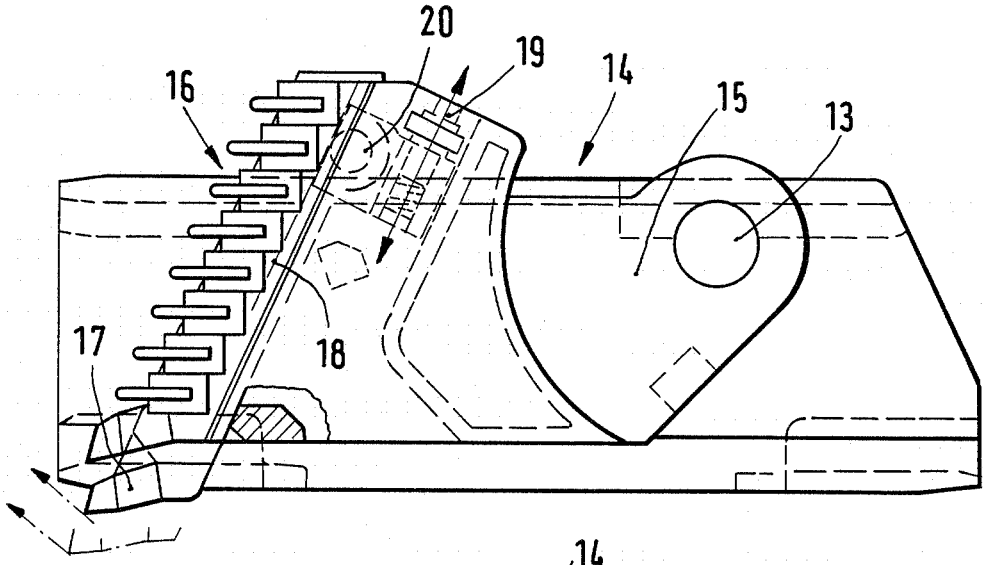
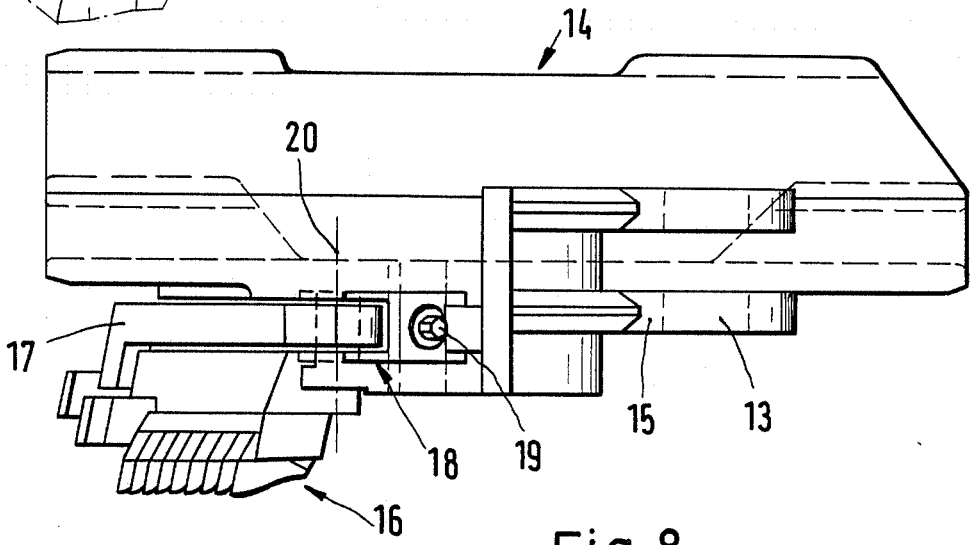
Fig. 8

Fig. 6
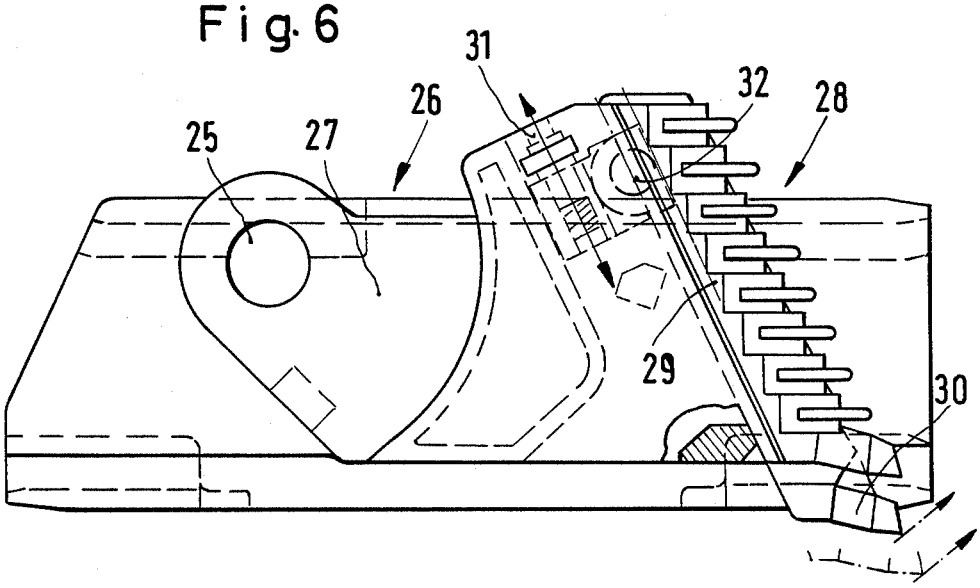
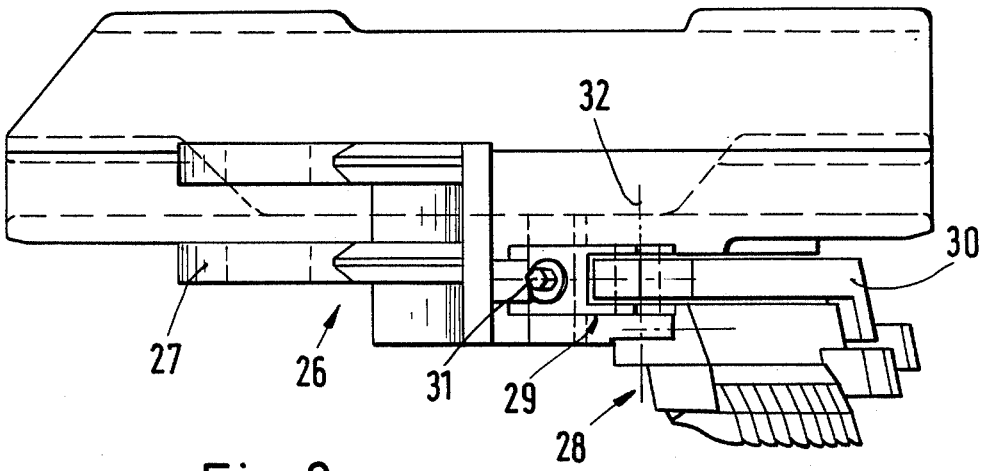
Fig. 9

COAL SHAVER

This application is a continuation, of application Ser. No. 861,297, filed May 9, 1986, now abandoned.

BACKGROUND OF THE INVENTION

1. Field of the Invention

The present invention relates to a coal shaver having at least two shaver foundations and mining tools at each shaver foundation which work in both cutting directions of the coal shaver; the coal shaver being guided and pulled back and forth parallel to the side wall of a coal deposit by a link chain and a guide and having an intermediate part between the two shaver foundations.

2. The Prior Art

A sliding shaver with two shaver foundations is known in the art. These foundations are connected via an intermediate carriage that is attached to articulate at both shaver foundations. The intermediate carriage functions like a coupling rod. In addition to this, there is a mounting bridge connecting the two shaver foundations and their set-up parts, to which a shaver portal is attached. The shaver foundations and the intermediate carriage are rigid units that are connected to articulate with one another at both ends of the intermediate carriage in order to facilitate the required movability to transfer saddles, drive through depressions and drive around conveyor belts.

A coal shaver with two shaver foundations is described in DE-OS No. 27 09 392. In this coal shaver the foundations are connected by a bridge to which the components are also arranged to articulate. The two shaver foundations are connected by a chain so as to be high in tension, whereas the shaver chain is attached to both outer ends of the shaver foundations.

Coal shavers with two shaver foundations are known in the art from the German specifications Nos. 21 40 609, 21 37 962 and 21 18 713. In these the shaver foundations are arranged to articulate at both ends of a bridge. Here, too, the shaver foundations represent rigid components, just like the bridge in which the two shaver foundations and the bridge are connected to articulate with one another in order to guarantee the required movability and articulateness.

SUMMARY OF THE INVENTION

The purpose of the present invention is to provide a coal shaver of the aforementioned type that is extremely rugged without an articulate connection between a bridge and the shaver foundations and requires only a very short shaver stable.

According to the invention both of the foundations or shaver device consist of a first cutter member and a second cutter member, and wherein the first cutter members of the shaver devices are rigidly connected to one another and the second cutter members are arranged to pivot with respect to the associated first cutter members.

In this manner a coal shaver of the aforementioned prior art type is constructed in which there is free passage for the coal that is to be loaded between the two shaver devices. It should also be mentioned that the two shaver devices are connected rigidly to one another and thus represent a rugged unit. Since the second cutter members are arranged to pivot with respect to the associated first cutter members, the coal shaver has the movability that is required for its movement through depressions and over humps.

In certain embodiments of the invention the arrangement can be made such that the first cutter members have a swivel bolt on which the second cutter members are arranged to pivot. This results in a rugged connection of the second cutter members to the first cutter members.

It is advisable to arrange the swivel bolt in about the middle of the upper region of the first cutter members. This results in a symmetrical formation of the shaver device with reference to the swivel bolt.

In one preferred embodiment of the invention the first cutter bodies are rigidly connected to one another via an elongated carriage body. This results in an especially rugged coal shaver because the first cutter members that are opposite one another are arranged in an unalterable position.

It is advisable that a hopper having loading ramps facing both cutting directions of the shaver be arranged on the elongated carriage body between the two shaver devices. This hopper represents an additional loading aid so that the mined coal does not have to be loaded exclusively via the shaver devices themselves onto the conveyer.

It is advisable to have a guide arm attached to the hopper. Thus one shaver device will be in front of the guide arm (in either direction of movement of the coal shaver) and the other shaver device will be behind the guide arm so that the coal mined in this manner is distributed equally in front of and behind the guide arm. The process results in efficient loading characteristics for the coal shaver.

Furthermore, another shaver body can be attached to the elongated carriage body between the two shaver devices so that this shaver will have three cutting fronts; these fronts result in a relaxed face with simultaneous large cutting depth and negligible pulling capacity of the chain.

The shaver (link) chain can be fastened to the elongated carriage body between the two shaver devices. The shaver chain can also be fastened to the loading ramp or to another shaver device. If another is present. The fastening of the shaver chain at approximately the middle of the coal shaver results in an advantageous distribution of the acting forces via the bolts on the guide carriages.

In addition to this, it is recommended that other shaver componenets be planned for the first cutter members and on the additional shaver body so that one can adapt to different seam thicknesses without further ado.

In other advantageous embodiments of the invention the elongated cutter strips which are attached to the two second cutter members are rigidly attached thereto, whereas the elongated cutter strips which are attached to the two first cutter members are arranged to pivot around an axis that extends in parallel with their longitudinal dimensions. In this respect the position of the end stops and the angles of horizontal swing of the movable cutter strips are selected such that the vertically spaced apart blades on the movable cutter strips in their folded-in position are further away from the side wall of the coal deposit than the blades of the rigid cutter strips and such that in the folded-out position of the movable cutter strips are closer to the side wall of the coal deposit than the blades of the rigid cutters trips. This guarantees that the swivelable cutter strips in one of the shaver cutting directions cut clearance for the rigid blades that follow them, whereas in the opposite shaver cutting direction the rigid cutter strip cuts clearance for the swivelable cutter strip that is located behind it.

If a shaver with only one single shaver device is used, it is advisable to arrange the cutter strips on the sides of the coal shaver to swivel around an axis that extends in their longitudinal dimensions. Thus, such a coal shaver with only a single shaver device also guarantees that the two cutter strips will cut clearance for each other in both cutting directions of the shaver.

The invention will be better understood by reference to the attached drawings and the following detailed discussion.

DESCRIPTION OF THE DRAWINGS

FIGS. 7A, 7B, 8 and 9 show top plan views of FIGS. 4A, 4B, 5 and 6, FIGS. 7A and 7B being extensions of one another along the line A-B.

DETAILED DESCRIPTION OF THE PREFERRED EMBODIMENTS

Figure 1:
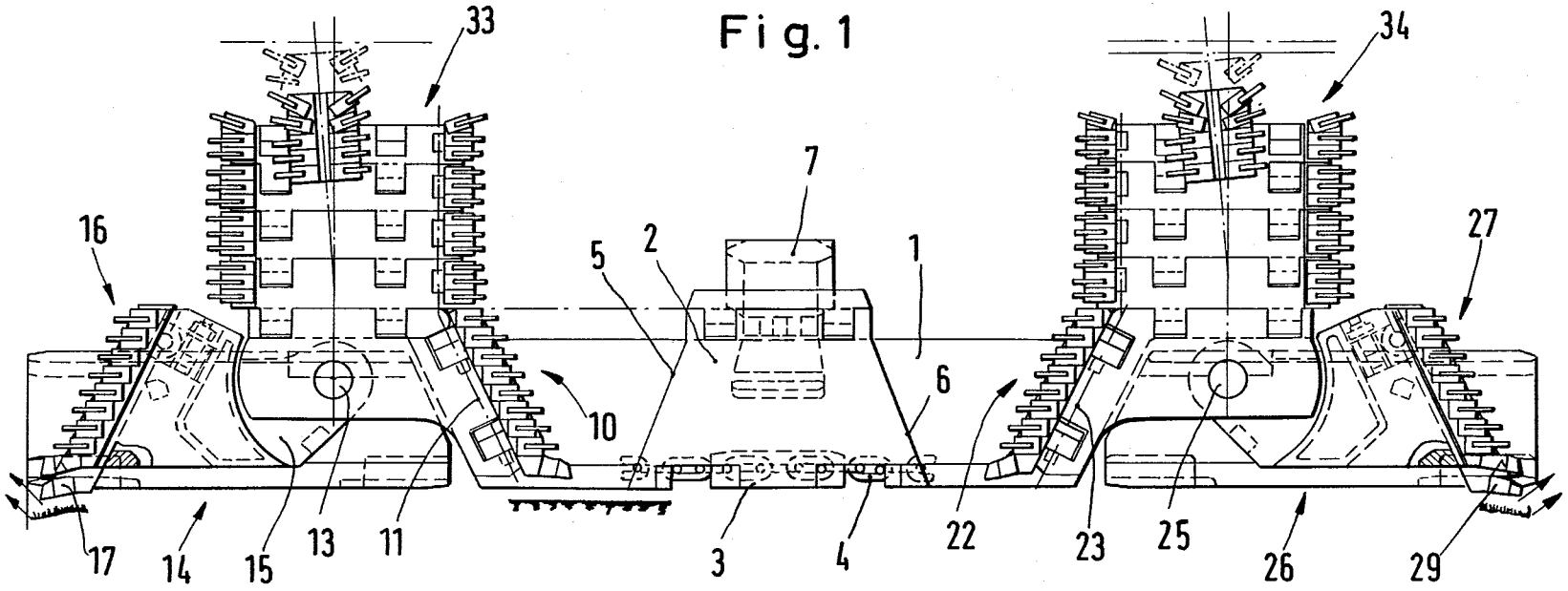
FIG. 1 is an elevational view of a first embodiment of coal shaver according to the present invention as seen from the front side thereof.
Figure 2:
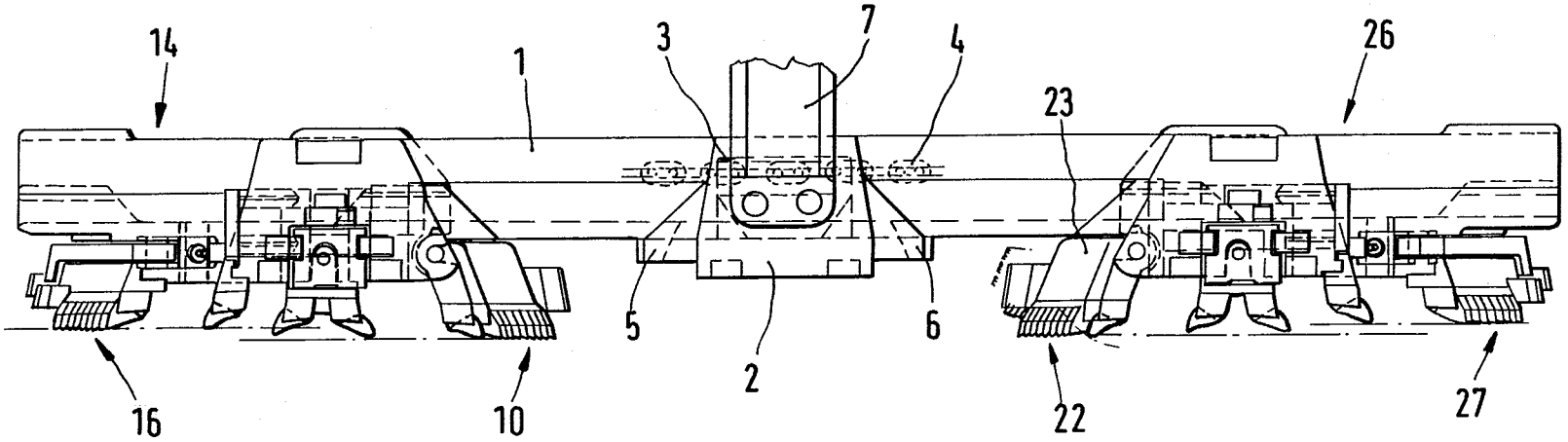
FIG. 2 is a top plan view of the coal shaver shown in FIG. 1.
Figure 3:
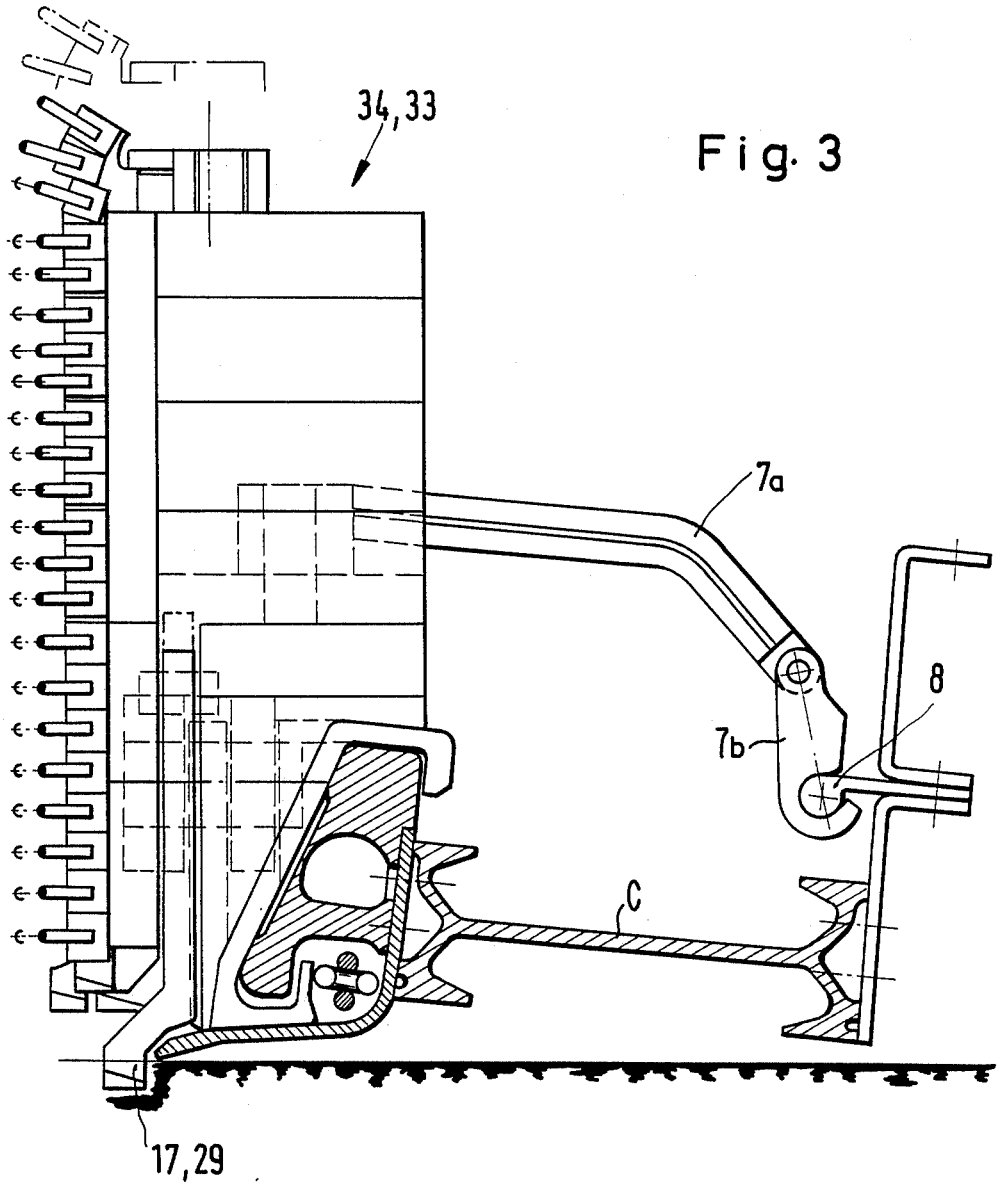
FIG. 3 is a right end view of the coal shaver shown in FIG. 1, FIGS. 4A, 4B, 5 and 6 are enlarged views of portions of the coal shaver shown in FIG. 1, FIGS. 4A and 4B being extensions of one another along the line A-B.
Figure 4A:
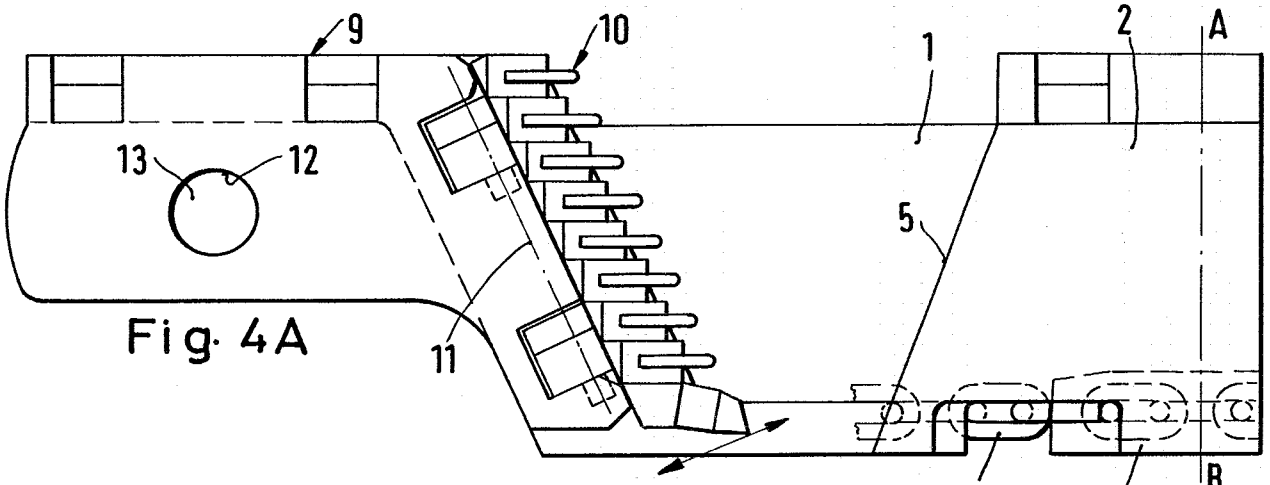
Figure 7A:
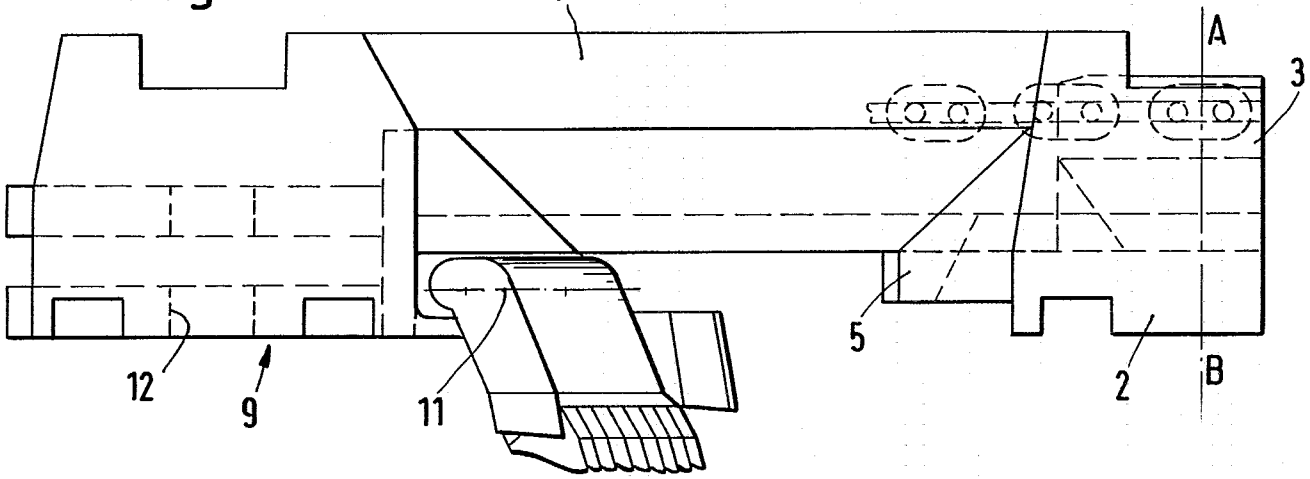
Figure 4B:
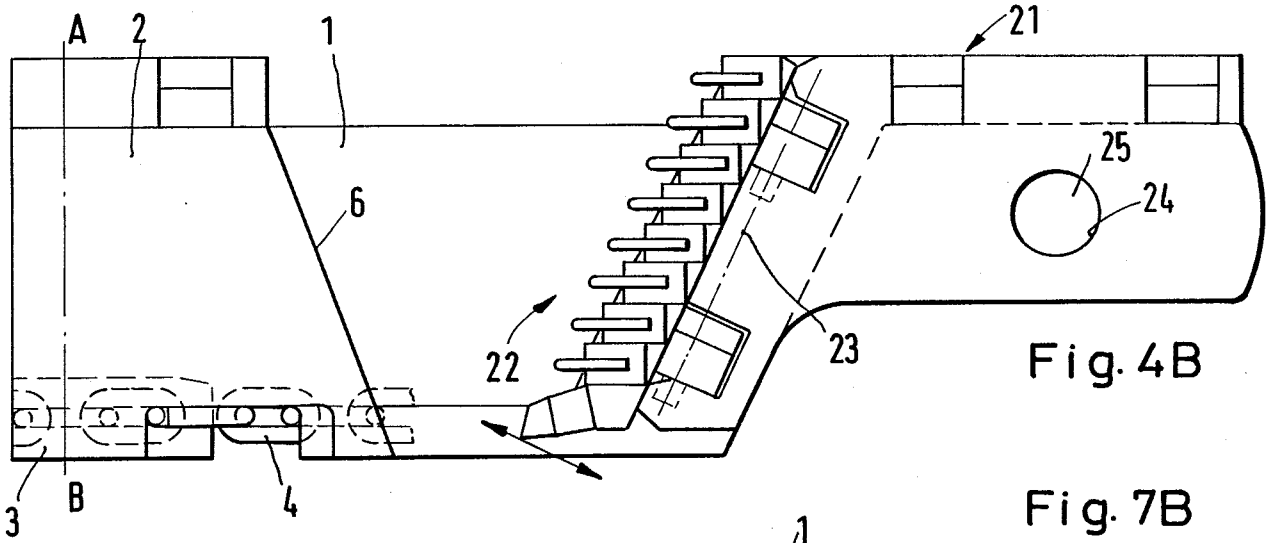
Figure 7B:
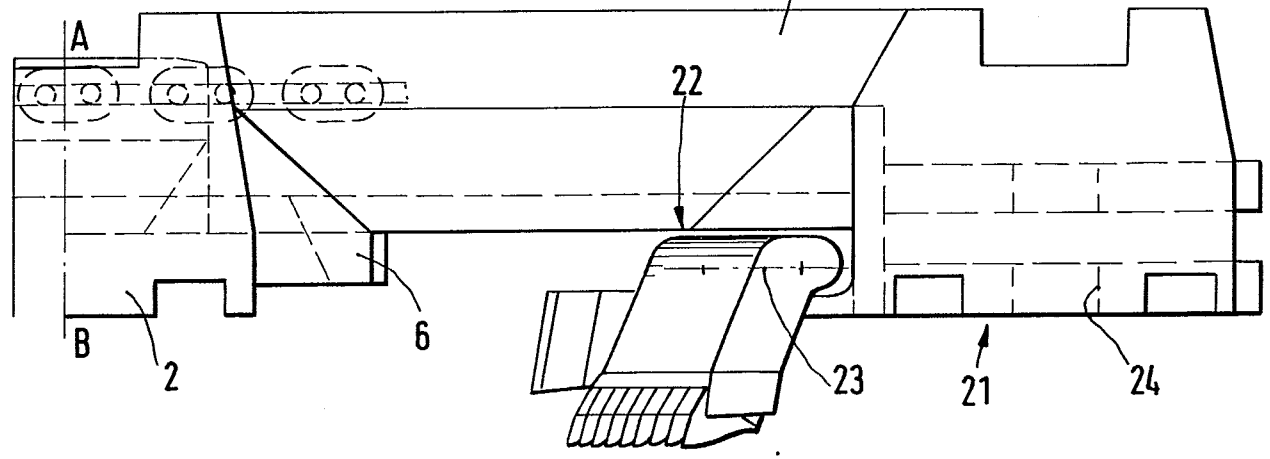

The coal shaver, shown in FIGS. 1 to 9, includes an elongated carriage body 1 with a hopper 2 to which a link drive chain 4 is attached via a pulley 3. The hopper 2 provides loading ramps 5 and 6 in both cutting directions of the shaver. The link chain 4 operates to move the elongated carriage body 1 back and forth in its longitudinal dimension parallel to the side wall of a coal deposit. An arm *7a* extends rearwardly from the hopper and is connected to a pivot arm *7b*, which is in turn guided along a rod 8 located above a conveyor C that extends parallel to the side wall of the coal deposit.

Mounted on the elongated carriage body 1 near one end thereof (shown on the left end in FIGS. 1 and 2) is a first shaver device. This shaver device includes a first cutter member 9, to which an inwardly facing cutter strip 10 that includes vertically spaced apart shearing blades, is pivotally attached, i.e., so as to pivot around a tiltable axis 11. The first cutter member 9 includes a bearing bore 12 to accept a bearing bolt 13 around which second cutter member 14 with a pivot arm 15 is arranged to pivot. A cutter strip 16 is rigidly attached to the outside of the second cutter member 14. Furthermore, there is a bottom blade 17 which can be longitudinally shifted in a guide 18 in the second cutter member 14 via a spindle 19. In the guide 18 there is a swivel bolt 20 around which the bottom blade 17 is arranged to pivot.

At the other end of the elongated carriage body 1 (shown on the right in FIGS. 1 and 2) there is a second shaver device which includes a first cutter member 21 which mounts an inwardly facing cutter strip 22 that includes vertically spaced apart shearing blades, the cutter strip 22 being pivotable about a tiltable axis 23. In the first cutter member 21 there is also a bearing bore 24 to accept a swivel bolt 25 around which a second cutter member 26 having a pivot arm 27 is arranged to pivot. A cutter strip 28 is rigidly attached to the second cutter member 26. Furthermore, a bottom blade 30 is arranged to be longitudinally shifted via a spindle 31 in a guide 29. In the guide 29 there is a swivel bolt 32 around which the bottom blade 30 is arranged to pivot.

Upper planer structures 33 and 34 for mining medium to larger thicknesses are respectively utilized on the first cutter members 9 and 21.

Figure 10:
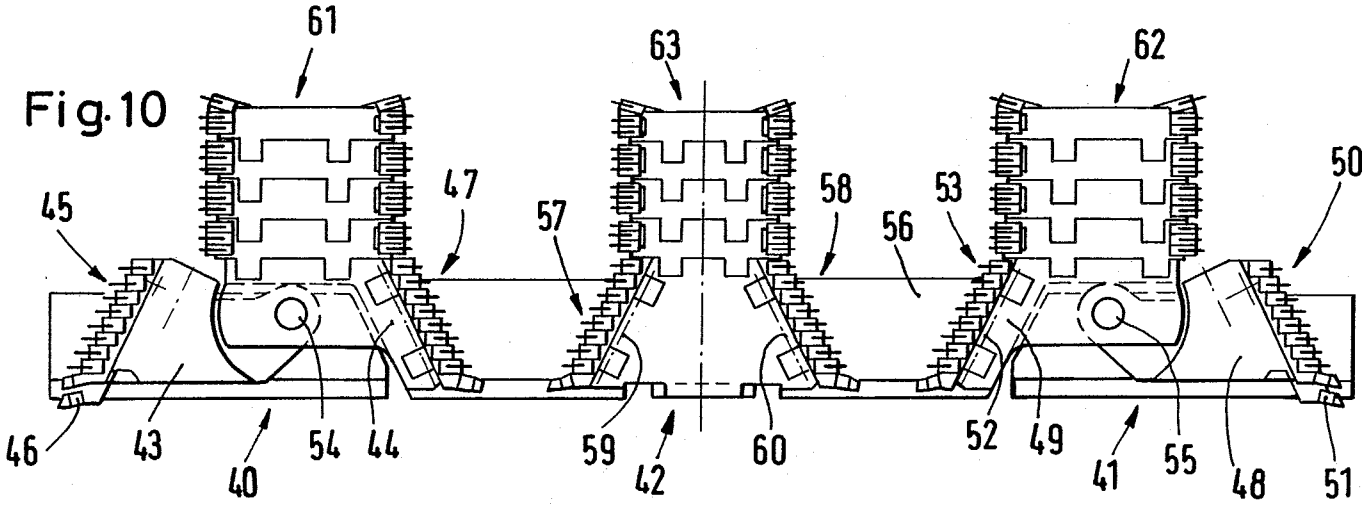
FIG. 10 is an elevational view of a second embodiment of coal shaver according to the present invention.
Figure 11:
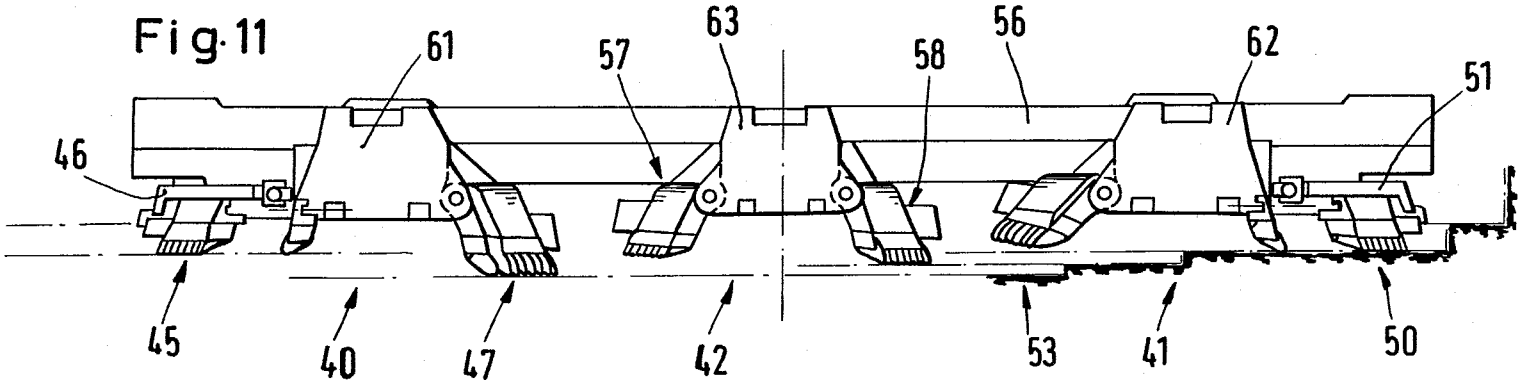
FIG. 11 is a top plan view of the coal shaver shown in FIG. 10.

A modified coal shaver is shown in FIGS. 10 and 11. It includes shaver devices 40 and 41 mounted on an elongated carriage body 56 near its opposite end, and a shaver body 42 mounted on the elongated carriage body therebetween. The shaver device 40 includes a first shaver member 44 and a second shaver member 43. The second shaver member 43 has a cutter strip 45 that is rigidly attached to it, whereas the bottom blade 46, which can be shifted in a longitudinal direction, is guided in a guide. A cutter strip 47 that is arranged to pivot is utilized on the first cutter member 44.

In the same manner the other shaver device 41 is comprised of a first shaver member 49 and a second shaver member 48. A rigid cutter strip 50 and a bottom blade 51, arranged to be shifted in the longitudinal direction of the cutter strip 50, are attached to the second shaver element 48. A cutter strip 53, arranged to pivot around the axis 52, is attached to the first shaver element 49.

Swivel bolts 54 and 55 are arranged approximately in the middle of the two shaver devices 40 and 41 in their upper region. The second shaver elements 43 and 48 of the shaver devices 40 and 41 are arranged to pivot around the swivel bolts. The shaver body 42 includes two cutter strips 57 and 58 that are attached opposite one another and are arranged to pivot around swivel axes 59 and 60.

Upper planer structures 61, 62 and 63 are respectively positioned on the shaver devices 40 and 41 and the shaver body 42.

I claim:

1. A coal shaver apparatus for shaving pieces of coal from a side wall of a coal deposit, said coal shaver apparatus comprising an elongated carriage body which is adapted for back and forth movement parallel to the side wall of a coal deposit, said elongated carriage body having a front side facing the side wall of the coal deposit and defining an elongated dimension, and two shaver devices which are respectively attached to said elongated carriage body, each shaver device defining an inner side which faces the other shaver device and an opposite outer side, said shaver devices including a first cutter member which is rigidly attached to said elongated carriage body and which mounts a first elongated cutter strip on said inner side of said shaver device, each said first elongated cutter strip including vertically spaced apart shearing blades that extend toward the side wall of the coal deposit and each said first elongated cutter strip being pivotable about an axis which extends upwardly and away from the other shaver device, a second cutter member which is pivotally mounted on each said first cutter member and which mounts a second elongated cutter strip on said outer side of said shaver device, each said second elongated cutter strip including vertically spaced apart shearing blades that extend toward the side wall of the coal deposit, and mounting means for mounting each said second cutter member on a respective said first cutter member so as to be pivotable about an axis which is perpendicular to said center line of said elongated dimension of said elongated carriage body.

2. A coal shaver according to claim 1, wherein said mounting means of each shaver device comprises a swivel bolt.

3. A coal shaver according to claim 1, including a hopper with loading ramps on opposite sides thereof mounted on said elongated carriage body between said shaver devices.

4. A coal shaver according to claim 3, wherein said hopper includes an arm which extends rearwardly thereof for cooperation with a guide rod that extends parallel to the side wall of the coal deposit.

5. A coal shaver according to claim 4, wherein said elongated carriage body includes means for attachment to a drive chain.

6. A coal shaver according to claim 1, including an upper planer structure positioned on each of said first cutter members.

7. A coal shaver according to claim 1, including a shaver body having elongated pivotable cutter strips on both sides thereof mounted on said elongated carriage body between said shaver devices.

8. A coal shaver according to claim 7, wherein said shaver body includes means for attachment to a drive chain.

9. A coal shaver according to claim 8, including an upper planer structure positioned on each of said first cutter members and said shaver body.

* * * * *